United States Patent [19]

Camilleri

[11] Patent Number: 4,662,595

[45] Date of Patent: May 5, 1987

[54] SUPPORT BRACE ASSEMBLY

[75] Inventor: Charles F. Camilleri, St. Louis, Mo.

[73] Assignee: Lee-Rowan Company, St. Louis, Mo.

[21] Appl. No.: 782,920

[22] Filed: Oct. 2, 1985

[51] Int. Cl.[4] ..... A47G 29/00

[52] U.S. Cl. ..... 248/250; 108/42; 211/90; 211/134; 411/57

[58] Field of Search ..... 248/235, 240, 240.2, 248/240.4, 249, 250, 247, 248; 108/42; 211/134, 144, 150, 106, 90; 411/57

[56] References Cited

U.S. PATENT DOCUMENTS

| | | | |
|---|---|---|---|
| 3,355,134 | 11/1967 | Chesley | 211/134 X |
| 4,022,100 | 8/1975 | Johnson | 411/57 |
| 4,220,301 | 9/1980 | Jacobs et al. | 248/74.3 |
| 4,316,593 | 2/1982 | Miner et al. | 211/90 |
| 4,317,262 | 3/1982 | Wells, Jr. | 248/74.3 |
| 4,361,099 | 11/1982 | Kokenge et al. | 211/134 X |
| 4,374,498 | 2/1983 | Yellin | 108/42 X |

FOREIGN PATENT DOCUMENTS

| | | | |
|---|---|---|---|
| 1213094 | 3/1966 | Fed. Rep. of Germany | 211/134 |

*Primary Examiner*—Reinaldo P. Machado
*Assistant Examiner*—David L. Talbott
*Attorney, Agent, or Firm*—Rogers, Howell, Moore, & Haferkamp

[57] ABSTRACT

A support brace assembly having a steel brace, a plastic cap at one end, and a plastic wall anchor at the other end. Interengageable means lock the cap to the brace. A retainer hinged to the cap. Complementrary recesses in the cap and retainer. Interengageable locking means to lock the retainer to the cap in either of two positions to form a wire enclosure of the complementary recesses sized to accommodate a wire of either of two diameters. Resilient retaining means on the wall anchor to hole it on the brace. Fingers on the wall anchor laterally expandable to engage a wall when a pin is driven into the wall anchor. A web in the path of the pin as it approaches the fingers.

22 Claims, 9 Drawing Figures

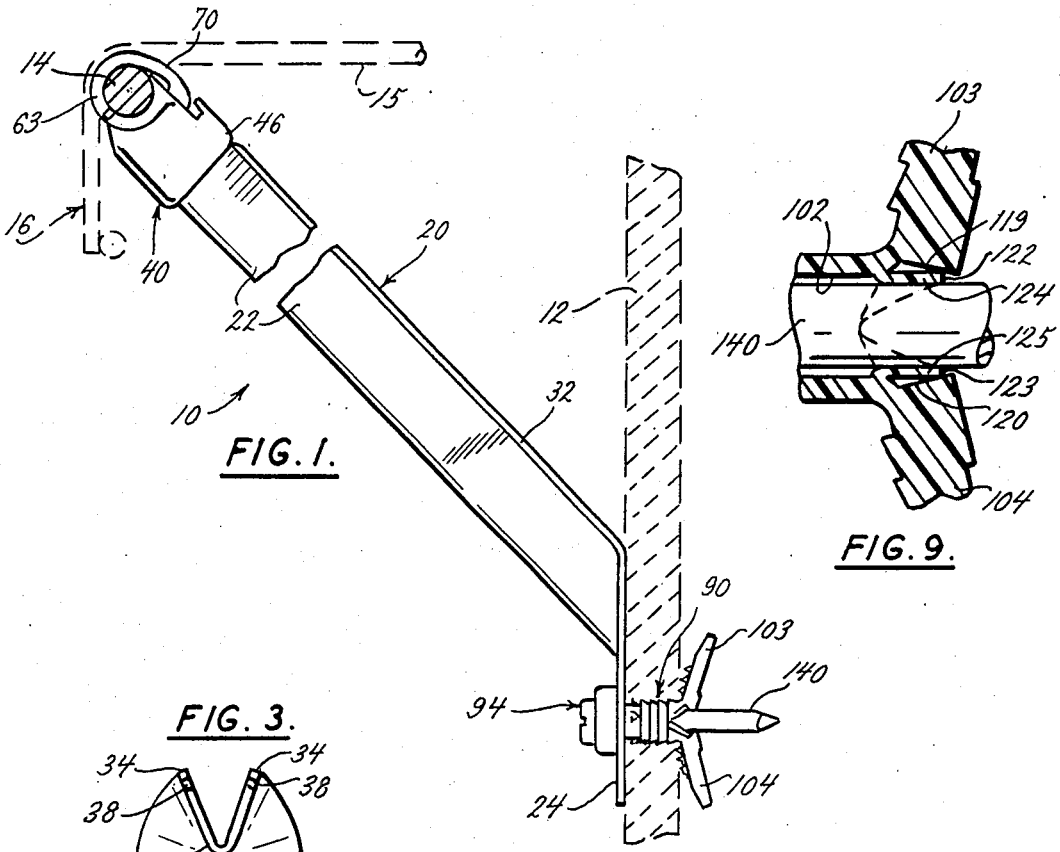
FIG. 1.
FIG. 9.
FIG. 3.
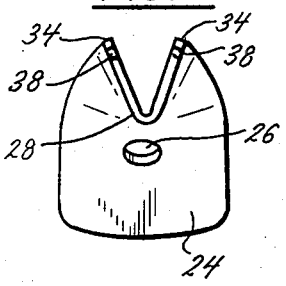
FIG. 2.
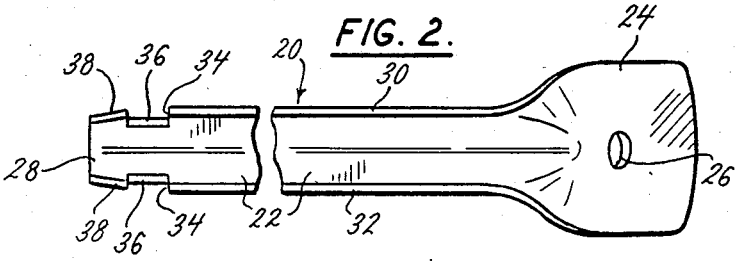
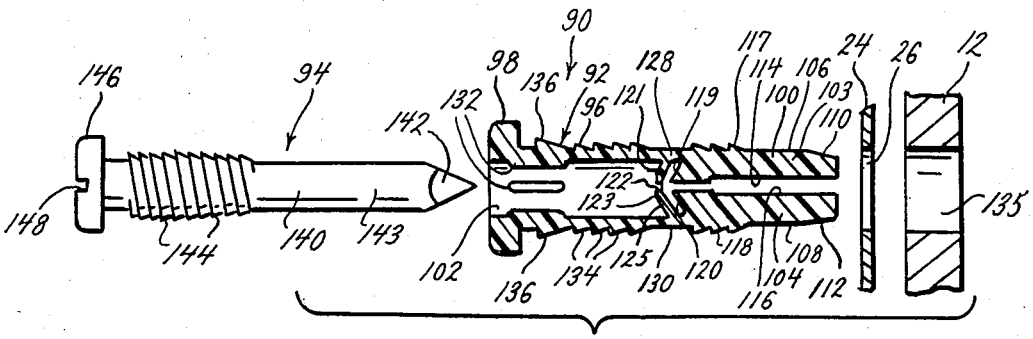
FIG. 4.

FIG. 5.
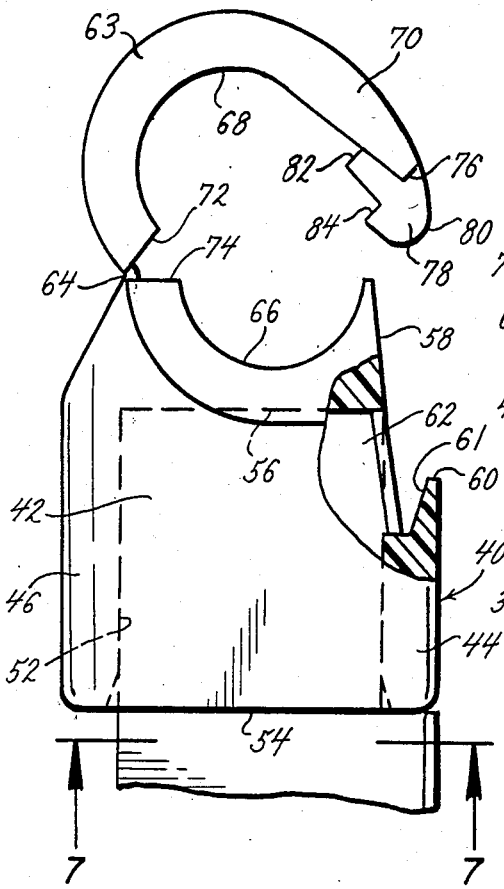
FIG. 6.
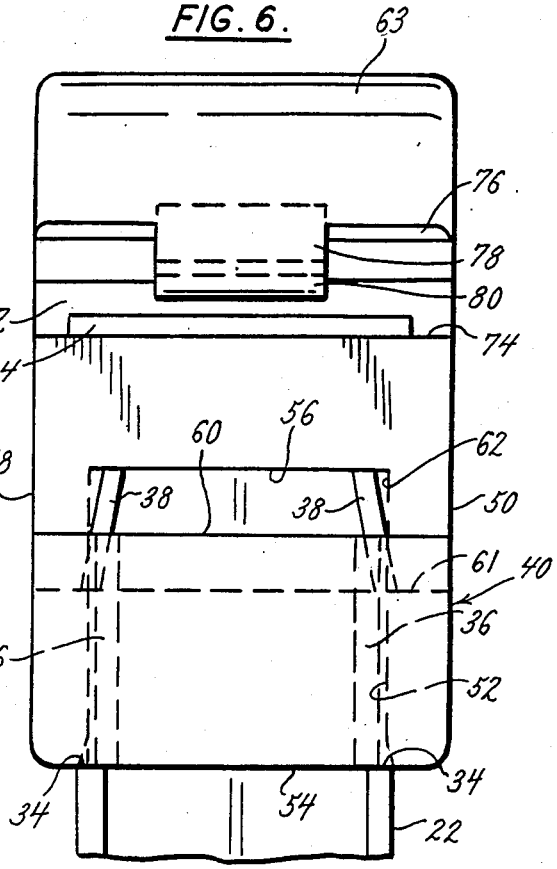
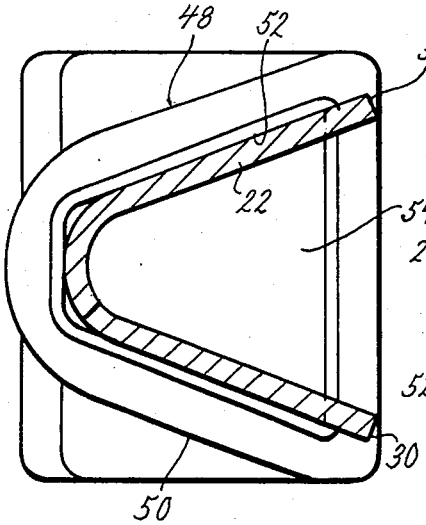
FIG. 7.
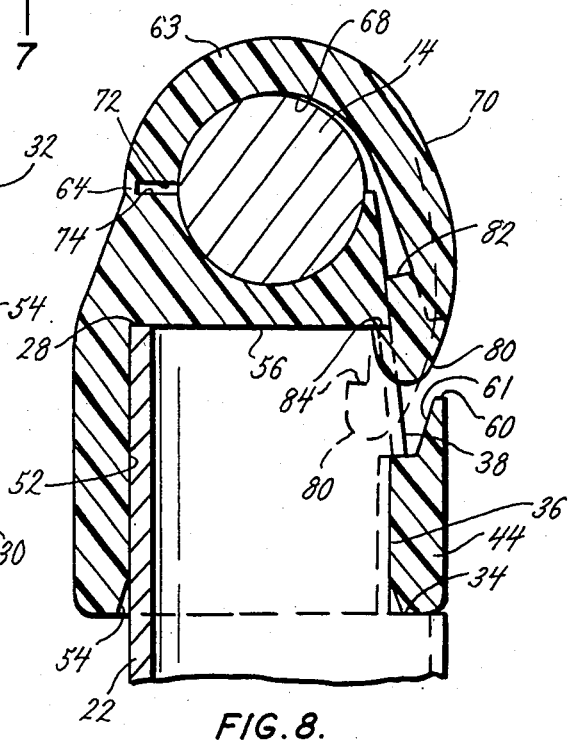
FIG. 8.

SUPPORT BRACE ASSEMBLY

BACKGROUND OF THE INVENTION

This invention relates to a brace assembly and in particular to a brace assembly having an end connectable to a wall surface by a wall anchor and an opposite end lockable to a wire or rod of a shelf at a point spaced from the wall surface.

In the art of shelving, shelf brackets, and shelf support brace assemblies, there has been a need for a support brace assembly that is rigid and strong enough to support the portion of a shelf that is spaced from a vertical wall, and yet can be quickly and easily installed, both to the wall and to the shelf. A further need is for such a support brace assembly that is easily attached to the shelf at one end regardless of whether the other end has yet been attached to a wall.

There is a further need for a support brace assembly that has a solid base for underlying and supporting a wire on a conventional shelf and that positively locks the wire to the support brace assembly even though the wire may be one of two different diameters. Toward the latter end, there is a need for a support brace assembly that has an elongated steel brace formed in a rigid span that extends from an end connected to a wall and an end spaced from the wall, but with a plastic cap on the last named end to facilitate a hinging closure to capture a wire of a shelf. The hinging closure is provided with stepped latch means to produce two closure sizes to accommodate two wire diameters. At the other end of the support brace, it is desirable to provide a quickly and easily operable device to connect the steel brace to a wall.

SUMMARY OF THE INVENTION

This support brace assembly comprises an elongated support brace of steel formed in a V for structural strength. A wall mount end of the brace is bent at about a forty-five degree angle and has a hole in it for receiving a wall anchor. Preferably, the wall anchor is a combination socket and drive pin. The socket is plastic and has a head at one end, with barbs spaced from the head. When the socket is extended within the hole and snapped in place, it will be retained on the wall mount end of the brace, ready for mounting to a wall. The wall anchor has laterally expandable fingers having transverse walls in the path of the pin to pivot the fingers upon driving the drive pin into a passage in the socket. The transverse walls are preferably inclined inwardly and toward the head of the socket so that the pin will pivot the fingers as far outwardly as possible toward ninety degree projections relative to the axis of the passage.

A special feature of this invention is the provision of a web slightly spaced from the transverse walls. There is a small opening through the web, such as a slit. Without the web, a stress line would be formed during molding, the end of the core forming the passage where that core intersects the transverse walls. By providing the web, the location of the stress line is moved to the intersection of the core and the web, and the walls joining the web and the transverse walls can be formed rounded with no stress lines. This avoids failure at the pivot lines of the fingers that might result from stress lines.

The web performs another function. As the drive pin is driven through the passage, it first contacts the web and, because the slit is parallel to the pivot lines of the fingers, the pin will split the web and pivot its halves toward the fingers. Thereafter, when the pin cams the fingers outwardly, the web halves lie against the pin and present edges opposing a tendency of the transverse walls to slide back along the pin. The wall anchor provides a quick and positive connector to mount the support brace assembly to a wall with the support brace extending laterally outwardly and upwardly from the wall at about a forty-five degree angle.

At its outer end, the support brace assembly includes a plastic shelf brace cap. Special connecting means are provided comprising hooks on the steel support brace and a recess in the shelf brace cap to engage and lock the shelf brace cap onto the support brace. The shelf brace cap has a body and a hook member connected by an integral hinge to the body. The hook member has a stepped latch lockably engageable with the aforesaid recess to form two separate sized openings to lock a shelf wire of either of two diameters.

This support brace assembly thus comprises a cooperable assembly of interlockable and interengageable metal and plastic components. The steel support brace provides strength to support a shelf. The plastic components are inexpensive to mold and yet are strong and provide positive connectors.

BRIEF DESCRIPTION OF THE DRAWINGS

FIG. 1 is a side elevation view of the support brace assembly showing its connections in dotted lines to a wall and a shelf;

FIG. 2 is a top view of the support brace;

FIG. 3 is an elevation view of the wall mount end of the support brace;

FIG. 4 is a pre-assembly view in longitudinal medial section through the wall anchor, a part, and a wall;

FIG. 5 is an enlarged side elevation view of the shelf brace cap with parts shown in section and showing the adjacent end of the support brace;

FIG. 6 is an enlarged front elevation view of the shelf brace cap;

FIG. 7 is a view in section along the plane of the line 7—7 of FIG. 5;

FIG. 8 is a side elevation view similar to that of FIG. 5, but with the shelf brace cap in closed condition and locked around a shelf wire; and FIG. 9 is an enlarged view in medial section of the central portion of the socket showing the web with the pin driven through it.

DETAILED DESCRIPTION OF PREFERRED EMBODIMENT

As FIG. 1 illustrates, this support brace assembly 10 is intended to be mounted to a wall 12 of a building and to extend outwardly to engage a transverse wire or rod 14 that supports spaced smaller wires 15 and is part of a length of shelving 16. This kind of wire shelving is conventional, and it will be understood that an edge of the shelving rests against the wall 12 and is fastened thereto by suitable connecting means (not shown). It is also known that in such shelving, the rod 14 typically may be sized in either of two diameters.

The support brace assembly includes a steel support brace 20 formed from a flat piece of steel stock that has been formed to a V cross section through the length of a central section 22. A wall mount end 24 is formed as an integral flat extension of the central section 22 and is bent at an angle thereto, preferably about forty-five degrees. There is a hole 26 in the wall mount end 24.

Opposite the wall mount end 24, the support brace 20 has a cap connecting end 28. At the cap connecting end 28, the sides 30 and 32 have been cut to form short walls 34 leading to short edges 36 and terminating in hook members 38. As thus formed, the cap connecting end 28 is adapted to be connected to a shelf brace cap 40 of the kind shown in FIGS. 5 through 8.

The shelf brace cap 40 is of molded plastic formed with a body 42 having a top wall 44, a bottom wall 46, and side walls 48 and 50. These walls surround a trapezoidal recess 52 having an open end 54. A wall 56 closes the other end of the recess 52 except the wall 56 terminates in a preferably inclined (see FIG. 5) flat wall 58 aligned with the inner side of the top wall 44. Similarly, the top wall 44 terminates in an edge 60 that is spaced from the wall 56 and that has a recessed area 61 shown in FIG. 5, thereby defining an opening 62.

A semi-cylindrical retainer 63 is connected to the body 42 by a short thin intergral plastic member 64 that is bendable to act as a hinge. A semi-cylindrical recess 66 is defined in the body, and the retainer 63 defines a complementary semi-cylindrical recess 68 to one side of which there is an extended leg 70. Next to the hinge 64, opposed walls 72 and 74 on the body 42 and retainer 63, respectively, are spaced from one another to allow the retainer to close in two positions without binding and undue stress on the hinge 64.

The extended leg 70 has an edge 76 from which a centrally positioned tongue 78 depends. The tongue 78 has a curved outer contour 80 to enable it to fit within the cutaway section 62 (see FIG. 8). The width of the tongue 78 is less than the span between the hook members 38 on the brace 20. On its inner side, the tongue has two ledges 82 and 84, each of which is adapted to snap into engagement with the wall 56 when the retainer 63 is pivoted to the solid or dotted line portions of FIG. 8. These stepped ledges 82 and 84 allow the retainer 63 to cooperate with the recess 66 and create either of two sizes of openings through the cap 40. This allows rods 14 of two diameters to be held snugly by the cap 40.

The wall mount end 24 is connected to a wall 12 by a connector, preferably like the wall anchor 90 illustrated in FIGS. 1, 4, and 9. The wall anchor 90 comprises a socket 92 and a drive pin 94. The socket 92 receives the drive pin 94 in a manner and for purposes which will be described hereinafter.

The socket 92 includes a body section 96, a head 98, and a finger section 100. There is a passage 102 through the head 98 and the body section 96 communicating with the finger section 100. The finger section 100 includes two fingers 103 and 104 having flat outer surfaces 106 and 108, respectively, terminating in tapered nose sections 110 and 112 at the lead end of the socket 92. Inwardly, the fingers 103 and 104 have opposed flat faces 114 and 116. Toward their trailing ends, the fingers 103 and 104 have barbs 117 and 118, respectively, that are sawtooth in side elevation as shown in FIG. 4.

The fingers 103 and 104 are formed with transverse walls 119 and 120 that extend across the passage 102 through the central section 96. Preferably, these walls 119 and 120 are at angles of about 60° to the axis of the passage 102, extending inwardly and toward the head 98.

Spaced from the walls 119 and 120, a web 121 is formed integral with the socket 92. A slit across the width of the web parallel to the faces 114 and 116 has opposed edges 122 and 123. The slit separates the web into two halves 124 and 125 which, as shown in FIG. 4, are generally parallel to the walls 119 and 120. Although the intersection of the passage 102 and the web may have a stress line, the short sections 128 and 130 can be unstressed and even rounded, as shown in FIG. 4. These are short sections 128 and 130 molded as integral parts of the plastic socket 92 of generally the same thickness as that of the wall of the body section 96 of the socket. The short sections 128 and 130 are bendable and act as hinges.

Referring to the body section 96, a plurality of longitudinally extending ribs 132 project inwardly on the inner wall of the passage 102. Four ribs 132 are shown, but that number is not critical. The primary purpose of these ribs 132 is to grip the shank of the drive pin 94, holding the pin 94 in a ready condition. In other words, the circumscribed internal diameter defined by the ribs 132 is slightly less than the diameter of the shank of the drive pin 94.

On the outer surface of the body section 96, there are a plurality of rings 134 that are generally sawtooth in side elevation. The outer diameters of the rings 134 are essentially the same as the span between the barbs 120 and 122 so that both the fingers 103 and 104 and the body section 96 of the socket 92 will fit in the same size pre-drilled hole 135 in the wall 12.

Between the rings 134 and the head 98, there are a plurality of barbs 136 defining a circumscribed circle, the diameter of which is greater than the diameter of the hole 26. These barbs 136 are spaced from the head 98 by about the thickness of the wall mount end 24. The function of the barbs 136 is to cooperate with the head 98 and retain the socket 92 on opposite sides of the wall mount end 24 prior to installation of the support brace assembly 10.

In its preferred form, the drive pin 94 has a shank 140 with a point 142 on its lead end, or the lead end can be semi-spherical. Generally, the lead section 143 of the shank 140 is cylindrical like a nail, whereas the trailing section is formed with a double helix thread 144. The double helix thread 144 is sawtooth in side elevation, as shown in FIG. 4, so that the drive pin 94 can be driven, such as by a hammer, into the socket 92 and can be rotated to withdraw it. For both of these purposes, there is a head 146 on the trailing end of the drive pin 94 with a screwdriver kerf or phillips slots 148 in it. The diameter of the cylindrical lead section 143 is about equal to the internal diameter of the passage 102, whereas the outer diameter of the helical threads 144 is greater than the diameter of the passage 102. Therefore, when the drive pin 94 is started into the passage 102 and pressed within the longitudinal ribs 132, the ribs 132 will grip the pin 94 and hold it in place. Because the socket 92 is plastic, it will yield, and the pin can be inserted manually.

Installation and Use

To prepare the support brace assembly for installation, the brace 20, cap 40, and wall anchor 90 (including the socket 92 and drive pin 94) are assembled. This can begin by inserting the cap connecting end 28 of the brace 20 into the recess 52, which preferably is an interference fit. When the end 28 reaches the wall 56 at the end of the recess 52, the hook members 38 will have reached the opening 62. The resilient pressure of the plastic will snap the hook members 38 into the opening 62, overlying the cut away section 61 of the wall 44, as shown in FIG. 1. This simple task can be performed manually.

The wall anchor socket 92 is installed on the wall mount end 24 of the brace 20 by inserting it into the hole 26 and applying pressure until the head 98 seats against the end 24. The plastic barbs 136 will yield as they pass through the hole 26 and will spring outwardly upon clearing the hole 26 to retain the socket in the hole with the head 98 on one side of the end 24 and the barbs 136 on the other side.

Either before or after this installation of the socket 92, the drive pin 94 can be pressed into a ready position within the socket 92. This likewise can be done manually by pressing the lead section 143 of the shank 140 into the passage 102 and into the area amid the longitudinal ribs 132. The pressure of the ribs 132 on the lead section 143 will hold the drive pin in the ready position within the socket 92 as shown in FIG. 1.

Installation of the shelf preferably should be next. Typically the rod 14 may be out of two different diameters. The rod 14 is set in the recess 66, and the retainer 63 is swung about the hinge 64 until the tongue 78 is opposite the opening 62. As a result of molding, the leg extension 70 is biased toward the opening 62.

If the rod 14 is the larger of two diameters, the retainer 63 is swung until the first ledge 84 engages the wall 56, as indicated in solid lines in FIG. 8. If the rod 14 is the smaller of the two diameters, the retainer 63 is pivoted further until the second ledge 82 engages the wall 56 as shown in dotted lines in FIG. 8.

The support brace assembly 10 can now be installed on the wall 12 by inserting the socket 92 into a predrilled hole 137 and driving the drive pin 94 further into the socket with a hammer. As the pin presses against the web 121, it deflects the web sections 124 and 125 toward the walls 119 and 120. Thereafter, the camming action of the shank 140 against the transverse walls 119 and 120 will pivot the fingers 103 and 104 outwardly behind the wall 24. Since the walls 119 and 120 are inclined to the axis of the passage and the hinge sections 128 and 130 are short, the fingers 103 and 104 will swing outwardly through 90° arcs, or nearly so, maximizing the holding power of the wall anchor 90. As illustrated in FIG. 9, the web havles 124 and 125 are now stretched along the pin shank 140, placing their edges 122 and 123 in positions to help hold the fingers 103 and 104 in their spread positions.

There are various changes and modifications which may be made to this invention as would be apparent to those skilled in the art. However, any of these changes or modifications are included in the teaching of this disclosure and this invention is limited only by the scope of the claims appended hereto.

What is claimed is:

1. A brace assembly to support a shelf from a vertical wall wherein the shelf is the kind having at least one wire parallel to and spaced from the wall and the brace assembly extends from said wire downwardly and angularly to the wall, comprising a brace having an elongated rigid central section between first and second ends, the first end having a wall mount portion intersecting the central section at an obtuse angle, the wall mount portion having a flat area with a hole through it to receive a connector for attachment of the wall mount portion to a wall surface, the second end including a cap having a body portion joined to the second end, a wall defining a recess in the body portion for receiving a side of the wire on the shelf, the open side ofthe recess facing the wire and the wall being generally aligned with the central section of the brace so that the force from the weight of the shelf bears against the wall and is transferred through the central section to the wall mount portion, a retainer having a recess complementary to the body portion recess, each recess having diametrically opposed edges and at right angles thereto having spaced open ends through which the wire can extend, hinge means connecting the retainer to the body portion adjacent one edge of the retainer recess and one edge of the body portion recess to enable the retainer to pivot between first and second positions, an extended arm on the retainer terminating at the other edge of the retainer recess, complementary interengageable tongue and keeper means in the extended arm and the body portion to lock the retainer in the second position in which the two recesses define an enclosure surrounding the wire, the load on the retainer being limited to generally upward forces on the shelf.

2. The brace assembly of claim 1 wherein the tongue and keeper means has two positions to enable the selection of two sizes of enclosure to accommodate two wire diameters.

3. The brace assembly of claim 1 wherein the brace including the central section and the wall mount portion are of steel, and the cap is plastic.

4. A brace assembly to support a shelf from a wall wherein the shelf is the kind having at least one wire parallel to and spaced from the wall, comprising a brace having an elongated rigid central section between first and second ends, the first end having a wall mount portion intersecting the central section at an obtuse angle, the wall mount portion having a flat area with a hole through it to receive a connector for attachment of the wall mount portion to a wall surface, the second end including a cap having a body portion joined to the second end, a recess in the body portion for receiving a side of the wire on the shelf, a retainer having a recess complementary to the body portion recess, each recess having diametrically opposed edges and at right angles thereto having spaced open ends through which the wire can extend, hinge means connecting the retainer to the body portion adjacent one edge of the retainer recess and one edge of the body portion recess to enable the retainer to pivot between first and second positions, an extended arm on the retainer terminating at the other edge of the retainer recess, complementary interengageable tongue and keeper means in the extended arm and the body portion to lock the retainer in the second position in which the two recesses define an enclosure surrounding the wire, the body portion of the cap including wall means defining a recess for receiving the second end of the brace, an opening through the wall means, and hook means on the second end of the brace for extending into the opening and locking the cap on the second end of the brace.

5. The brace assembly of claim 4 wherein the opening also constitutes the keeper means, the tongue comprising a projection extending from the extended arm of the retainer, the opening being in the path of the projection when the retainer is pivoted toward the second position, a ledge on the projection for engaging the wall means and locking the retainer in the second position.

6. The brace assembly of claim 4 wherein the hook means comprises two spaced hook members on the second end of the brace, the projection being received within the opening between the hook members.

7. A brace assembly to support a shelf from a wall wherein the shelf is the kind having at least one wire parallel to and spaced from the wall, comprising a brace having an elongated rigid central section between first and second ends, the first end having a wall mount portion intersecting the central section at an obtuse angle, the wall mount portion having a flat area with a hole through it to receive a connector for attachment of the wall mount portion to a wall surface, the second end including a cap having a body portion joined to the second end, a recess in the body portion for receiving a side of the wire on the shelf, a retainer having a recess complementary to the body portion recess, each recess having diametrically opposed edges and at right angles thereto having spaced open ends through which the wire can extend, hinge means connecting the retainer to the body portion adjacent one edge of the retainer recess and one edge of the body portion recess to enable the retainer to pivot between first and second positions, an extended arm on the retainer terminating at the other edge of the retainer recess, complementary interengageable tongue and keeper means in the extended arm and the body portion to lock the retainer in the second position in which the two recesses define an enclosure surrounding the wire, the connector comprising a pin and socket, the socket including a body section with a leading end and a trailing end, a pair of fingers connected to the trailing end for lateral movement relative to the body, a passage through the body section for receiving the pin, the fingers having a wall portions in the path of the pin to move the fingers laterally outwardly when engaged by the pin, a head on the body section, retainer means spaced from the head in a plane parallel to the head, the diameter of the head and the circumscribed diameter of the retainer means being greater than the diameter of the hole through the wall mount portion, the distance between the head and the plane being about the same as the thickness of the wall mount portion, the socket being of resilient plastic whereby the socket can be pressed into the hole in the wall mount portion and the retainer means will yield to fit through the hole until the wall mount portion is between the head and the retainer means at which position the retainer means will snap outwardly and retain the socket on the wall mount portion.

8. The brace assembly of claim 7 including longitudinal ribs projecting radially inwardly of the passage to grip the pin and hold it ready to be driven into engagement with the fingers.

9. The brace assembly of claim 7 wherein the retainer means has a first surface facing the leading end of the body section and a second surface facing the trailing end of the body section, the first surface being at an angle of less than 30° to the axis of the body section, the second surface being at an angle of greater than 60° to the body section.

10. A support brace assembly comprising a steel brace having first and second ends, a plastic socket, a hole in the first end of the brace, means integral with the socket to releasably attach the socket to the brace with the socket projecting through the hole, laterally extendable wall engaging members on the socket, a passage through the socket, and a pin driveable through the passage for laterally extending the wall engaging members, a plastic cap, means to connect the plastic cap to the second end of the brace, means on the body defining a wire receiving recess of generally semi-cylindrical shape, a retainer, plastic hinge means connecting the retainer to the cap, a generally semi-cylindrical recess within the retainer complementary to the recess in the cap, and interengageable locking means between the retainer and the cap to lock the retainer to the recess in a position in which the two recesses generally define a closed cylinder to surround a shelf wire.

11. The support brace assembly of claim 10 wherein the interengageable locking means comprises a wall on the cap and stepped ledges on the retainer.

12. The support brace assembly of claim 10 wherein the hinge means comprises a short thin strip, and the cap, retainer, and hinge are of integral molded plastic.

13. The support brace assembly of claim 10 wherein the brace comprises an elongated member generally V-shaped in cross section having two legs with common edges joined together and free edges spaced therefrom, a pocket in the cap for receiving the second end of the brace, and interengageable locking means between the cap and the brace for locking the second end within the pocket.

14. The support brace assembly of claim 13 wherein the cap has contiguous side walls defining the sides of the pocket, the side walls of the cap defining a pocket that will receive the second end of the brace in only a single orientation with the free edges against a predetermined one of the side walls, the interengageable locking means between the cap and brace comprising an opening through the predetermined side wall, a hook projecting from each free edge of the brace at the second end thereof and sized to fit within the opening.

15. The support brace assembly of claim 14 wherein the cap has an end wall normal and joined to the side walls, the opening comprising a gap between the end wall and the predetermined side wall.

16. The support brace assembly of claim 14 wherein the brace has ledges adjacent and normal to the second end for contacting and acting as stops against an edge of the predetermined side wall.

17. The support brace assembly of claim 10 wherein the wall engaging members comprise fingers, hinge means pivotally joining the fingers to the socket, walls on the fingers engageable by the pin to pivot the fingers, a web joined to the socket and extending inwardly into the passage in the path of the pin as it is driven toward the fingers.

18. The support brace assembly of claim 17 including a slit in the web, the web extending generally across the passage and being joined to a circumference of the passage.

19. The support brace assembly of claim 17 wherein the walls of the fingers are inclined inwardly and away from the fingers.

20. The support brace assembly of claim 19 wherein the angle of inclination is between about 55 degrees and about 65 degrees to the axis of the passage.

21. The support brace assembly of claim 19 wherein the web has portions generally parallel to the walls of the fingers.

22. The support brace assembly of claim 17 wherein the web is spaced from the walls of the fingers.

* * * * *